United States Patent [19]

Bedenk et al.

[11] 4,073,996

[45] Feb. 14, 1978

[54] FABRIC TREATING ARTICLES AND PROCESSES

[75] Inventors: William Thomas Bedenk, Springfield Township, Hamilton County; Paul Joseph Sagel, Green Township, Hamilton County, both of Ohio

[73] Assignee: The Procter & Gamble Company, Cincinnati, Ohio

[21] Appl. No.: 660,951

[22] Filed: Feb. 24, 1976

[51] Int. Cl.[2] ..... D06M 11/00; B05D 3/12

[52] U.S. Cl. ..... 428/274; 252/8.6; 252/8.8; 428/454; 428/537; 427/242

[58] Field of Search ..... 252/8.6, 8.75, 8.8, 252/113, 131, 155, 528, 546, 547; 428/264, 274, 454, 537; 427/242

[56] References Cited

U.S. PATENT DOCUMENTS

| | | | |
|---|---|---|---|
| 3,095,373 | 6/1963 | Blomfield | 252/8.8 |
| 3,442,692 | 5/1969 | Gaiser | 427/242 X |
| 3,501,335 | 3/1970 | Cahn et al. | 427/242 X |
| 3,686,025 | 8/1972 | Morton | 427/242 X |
| 3,743,534 | 7/1973 | Zamora | 427/242 X |
| 3,796,599 | 3/1974 | McLaughlin | 427/242 |
| 3,862,058 | 1/1975 | Nirschl et al. | 252/528 |
| 3,870,145 | 3/1975 | Mizuno | 427/242 X |
| 3,886,075 | 5/1975 | Bernardino | 252/8.75 |
| 3,977,980 | 8/1976 | Fry et al. | 252/8.8 |
| 3,989,631 | 11/1976 | Marsan | 252/8.6 |
| 3,993,573 | 11/1976 | Gloss | 252/89 R |
| 4,041,205 | 8/1977 | Compa et al. | 428/220 |

FOREIGN PATENT DOCUMENTS

| | | | |
|---|---|---|---|
| 881,407 | 9/1971 | Canada | 427/242 |

*Primary Examiner*—Michael R. Lusignan
*Attorney, Agent, or Firm*—Douglas C. Mohl; Ronald L. Hemingway; Richard C. Witte

[57] ABSTRACT

Fabric conditioning articles comprising a water-insoluble particulate clay, fabric organic conditioning agents and a dispensing means especially adapted for use in automatic clothes dryers are described.

19 Claims, No Drawings

FABRIC TREATING ARTICLES AND PROCESSES

BACKGROUND OF THE INVENTION

This invention relates to articles and methods for supplying softening and antistatic benefits to clothes in an automatic clothes dryer. The articles comprise a mixture of particulate clay and fabric conditioning agents releasably combined with a dispensing means.

Treating fabrics in an automatic clothes dryer has recently been shown to be an effective means for conditioning and imparting desirable tactile properties thereto. In particular, it is becoming common to soften fabrics in an automatic clothes dryer rather than during the rinse cycle of a laundering operation. Treating fabrics in the dryer, rather than in the wash, enables the formulator of fabric conditioners to develop and use materials which may not be compatible with detergents. Moreover, the user of dryer-added conditioners is not compelled to make the special effort required with many rinse-added products.

The art disclosed dryer-added fabric conditioners oftentimes suffered from fabric staining and dryer compatibility problems. Overcoming these problems has been the object of extensive work in the dryer conditioning field.

The present invention is based on the discovery that fabrics can receive softening and antistatic benefits from an article containing a mixture of a particulate clay and organic conditioning agents while being dried in an automatic clothes dryer. The conditioning benefits are received while fabric staining and dryer compatibility problems are reduced.

It is an object of the present invention, therefore, to provide articles which can be added to a clothes dryer to condition fabrics concurrently with a dryer operation.

It is a further object herein to provide methods for conditioning fabrics.

These and other objects will become obvious from the following disclosure.

DESCRIPTION OF THE PRIOR ART

U.S. Pat. No. 3,822,145, Liebowitz et al., FABRIC SOFTENING, issued July 2, 1974, relates to the use of spherical materials as fabric softening agents. U.S. Pat. Nos. 3,743,534, Zamora, et al., PROCESS FOR SOFTENING FABRICS IN A DRYER, issued July 3, 1973; 3,698,095, Grand, et al., FIBER CONDITIONING ARTICLE, issued Oct. 17, 1972; 3,686,025, Morton, TEXTILE SOFTENING AGENTS IMPREGNATED INTO ABSORBENT MATERIALS, issued Aug. 22, 1972; 3,676,199, Hewitt, et al., FABRIC CONDITIONING ARTICLE AND USE THEREOF, issued July 11, 1972; 3,633,538, Hoeflin, SPHERICAL DEVICE FOR CONDITIONING FABRICS IN DRYER, issued Jan. 11, 1972; 3,634,947, Furgal, COATING APPARATUS, issued Jan. 18, 1972; 3,632,396, Zamora, DRYER-ADDED FABRIC SOFTENING COMPOSITIONS, issued Jan. 4, 1972; and 3,442,692, Gaiser, METHOD OF CONDITIONING FABRICS, issued May 6, 1969, each relate to articles and methods for conditioning fabrics in automatic dryers. U.S. Pat. No. 3,594,212, Ditsch, TREATMENT OF FIBROUS MATERIALS WITH MONTMORILLONITE CLAYS AND POLYAMINES AND POLYQUATERNARY AMMONIUM COMPOUNDS relates to the treatment of fibrous materials with clays and amine or ammonium compounds.

U.S. Pat. No. 3,861,870, Edwards and Diehl, entitled FABRIC SOFTENING COMPOSITIONS WITH IMPROVED CONDITIONING PROPERTIES, issued Jan. 21, 1975, discloses mixtures of fabric softeners and particulate, non-clay conditioners. The co-pending applications of Murphy et al., Ser. No. 543,606, filed Jan. 23, 1975; Zaki, Ser. No. 543,607, filed Jan. 23, 1975; and Marsan, Ser. No. 533,742, filed Dec. 17, 1974, each relate to dryer-added fabric softeners and articles of various types. Marsan discloses clay mixtures for conditioning fabrics.

U.S. Pat. No. 3,716,488, Kolsky et al., TEXTILE FABRIC CLEANING COMPOSITIONS, issued Feb. 13, 1973, relates to smectite clays in detergent compositions.

U.S. Pat. No. 3,765,911, Knowles et al., PROCESSING OF RUBBER AND THE LIKE, and to processing compositions therefor, discloses certain soap plus colloidal clay particle compositions as antitack coatings on solid substrates.

SUMMARY OF THE INVENTION

The instant invention is based on the discovery that superior fabric conditioning articles can be prepared by combining a mixture of a particulate clay and organic fabric conditioning agents with a dispensing means.

In its process aspect, this invention encompasses a process for conditioning fabrics comprising combining an article of the type disclosed above with damp fabrics in an automatic clothes dryer and operating the dryer, with tumbling, in standard fashion.

DETAILED DESCRIPTION OF THE INVENTION

The articles herein comprise multiple components, each of which is described, in turn, below.

CLAYS

The substantially water-insoluble particulate clay used in the instant invention is preferably an impalpable smectite-type clay.

The smectite clays can be described as expandable, three-layer clays, i.e., alumino-silicates and magnesium silicates, having an ion exchange capacity of at least about 50 meq/100 g. of clay. The term "impalpable" as used to describe the clays employed herein means that the individual clay particles are of a size that they cannot be perceived tactilely. (Of course, this is important since the clay should not make the treated fabric gritty.) Such particle sizes are within the range below about 50 microns. In general, the smectite clays used herein have a particle size within the range of from about 0.05 microns to about 25 microns, with the smaller particles being preferred since they are less noticeable on fabric surfaces. The term "expandable" as used to described clays relates to the ability of the layered clay structure to be swollen, or expanded, on contact with water. Such three-layer expandable clays are classified geologically as smectites.

There are two distinct classes of smectite-type clays useful herein. In the first, aluminum oxide is present in the silicate crystal lattice; in the second class of smectites, magnesium oxide is present in the silicate crystal lattice. The general formulas of these smectites are $Al_2(Si_2O_5)_2(OH)_2$ and $Mg_3(Si_2O_5)_2(OH)_2$, for the aluminum and magnesium oxide type clays, respectively. It is to be recognized that the range of the water of hydration in the above formulas can vary with the processing to which the clay has been subjected. This is immaterial to the use of the smectite clays in the present invention in that the expandable characteristics of the hydrated clays are dictated by the silicate lattice structure. Furthermore, atom substitution by iron and magnesium can occur within the crystal lattice of the smectites, while metal cations such as $Na^+$, $Ca^{++}$, as well as $H^+$, can be co-present in the water of hydration to provide electrical neutrality. Except as noted hereinafter, such cation substitutions are immaterial to the use of the clays herein since the desirable physical properties of the clays are not substantially altered thereby.

The three-layer, expandable alumino-silicates useful herein are further characterized by a dioctahedral crystal lattice, while the expandable three-layer magnesium silicates have a trioctahedral crystal lattice.

As noted hereinabove, the smectite-type clays employed in the instant invention can contain cationic counterions such as protons, sodium ions, potassium ions, calcium ions, magnesium ions, and the like. It is customary to distinguish between clays on the basis of one cation predominantly or exclusively absorbed. For example, a sodium clay is one in which the absorbed cation is predominantly sodium. Such absorbed cations can become involved in equilibrium exchange reactions with cations present in aqueous solutions. In such equilibrium reactions, one equivalent weight of solution cation replaces an equivalent weight of sodium, for example, and it is customary to measure clay cation exchange capacity (sometimes called "base exchange capacity") in terms of milliequivalents per 100 g. of clay (meq/100g.). The cation exchange capacity of clays can be measured in several ways, including electrodialysis, by exchange with ammonium ion followed by titration, or by a methylene blue procedure, all as fully set forth in Grimshaw, *The Chemistry and Physics of Clays,* Interscience Publishers, Inc. pp. 264–265 (1971). The cation exchange capacity of a clay mineral relates to such factors as the expandable properties of the clay, the charge of the clay, which in turn, is determined at least in part by the lattice structure, and the like. The ion exchange capacity of clays varies widely in the range from about 2 meq/100 g. for kaolinites to about 150 meq/100 g., and greater, for certain clays of the montmorillonite variety. Illite clays have an ion exchange capacity somewhere in the lower portion of the range, ca. 26 meq/100 g. for an average illite clay.

Illite and kaolinite clays, with their relatively low ion exchange capacities, are not preferred for use in the instant compositions. However, smectites, such as nontronite, having an ion exchange capacity of approximately 50 meq/100 g.; saponite, which has an ion exchange capacity of around 70 meq/100 g.; and montmorillonite, which has an ion exchange capacity greater than 70 meq/100 g., are preferred for use in the compositions herein.

The smectite clays used herein are all commercially available. Such clays include, for example, montmorillonite, volchonskoite, nontronite, hectorite, saponite, sauconite, and vermiculate. The clays herein are available under commercial names such as "fooler clay" (clay found in a relatively thin vein above the main bentonite or montmorillonite veins in the Black Hills) and various tradenames such as Thixogel #1 (also, "Thixo-Jell") and Gelwhite GP from Georgia Kaolin Co., Elizabeth, N.J., Volclay BC and Volclay #325, from American Colloid Co., Skokie, Ill.; Black Hills Bentonite BH 450 from International Minerals and Chemicals; and Veegum Pro and Veegum F, from R. T. Vanderbilt. It is to be recognized that such smectite-type minerals obtained under the foregoing commercial and tradenames can comprise mixtures of the various discrete mineral entities. Such mixtures of the smectite minerals are suitable for use herein.

While any of the impalpable smectite-type clays are useful herein, certain clays are preferred. For example, Gelwhite GP and "fooler clay" are extremely white forms of smectite clays and are preferred for this reason. Volclay BC, which is a smectite-type clay mineral containing at least 3% iron (expressed as $Fe_2O_3$) in the crystal lattice, and which has a very high ion exchange capacity, is one of the most efficient and effective clays from the standpoint of fabric softening performance. Gelwhite GP is a preferred clay herein from the standpoint of fabric softening, fabric staining and dryer compatibility performance.

Appropriate smectite clay minerals for use herein can be selected by virtue of the fact that smectites exhibit an X-ray diffraction pattern of about 9.2A. This characteristic pattern, together with exchange capacity measurements, provides a basis for selecting suitable impalpable smectite-type clay minerals for use as softeners in the manner of the present invention.

ORGANIC CONDITIONING AGENTS

The clay materials described previously are applied to fabrics in combination with an organic fabric conditioning agents (fabric softener or antistatic agent) to secure additional conditioning benefits therefrom. Any of the known organic conditioning agents can be employed herein with cationic fabric conditioning agents being preferred. However, since the articles herein are used in automatic dryers, it is especially preferred to select conditioning agents adapted for use therein. Such fabric conditioning agents are those which melt (or flow) at dryer operating temperatures and which are transferred from a dispensing means onto clothes coming in contact therewith in the dryer. Preferably the organic fabric conditioning agents used herein are characterized by a melting point above about 38° C. Lower melting organic softeners when used alone flow at room temperature and result in an undesirable tackiness, both in the article and on the fabrics treated therewith. Highly preferred among the organic softeners and antistatic agents for use herein are those which melt (or flow) at temperatures from about 40° C to about 70° C, i.e., temperatures within the range found in most home dryers. However, fabric conditioning agents which melt at temperatures up to 100° C, and higher, are useful in commercial dryers.

It is understood that mixtures of fabric conditioning agents can be employed herein concurrently to achieve multiple conditioning benefits. However, since cationic agents are preferred for use herein, the organic conditioning agent portion of the articles of this invention should contain not less than 5% of cationic agents. The above-mentioned preferred melting point requirements should preferably be met by any mixture of agents used herein even if one or more agents of the mixture does not. Mixtures of the cationic and nonionic agents described below can provide benefits not obtained by the use of either alone.

Typical organic fabric conditioning agents employed herein are any of the cationic (including imidazolinium)

compounds listed in U.S. Pat. No. 3,686,025, Morton, TEXTILE SOFTENING AGENTS IMPREGNATED INTO ABSORBENT MATERIALS, issued Aug. 22, 1972, incorporated herein by reference. Such materials are well known in the art and include, for example, the quaternary ammonium salts having at least one, preferably two, $C_{10}$–$C_{20}$ fatty alkyl substituent groups; alkyl imidazolinium salts wherein at least one alkyl group contains a $C_8$–$C_{25}$ carbon "chain"; the $C_{12}$–$C_{20}$ alkyl pyridinium salts, and the like.

Preferred cationic conditioning agents herein include the quaternary ammonium salts of the general formula $R^1R^2R^3R^4N^+$, $X^-$, wherein groups $R^1$, $R^2$, $R^3$, and $R^4$ are, for example, alkyl or benzyl, and $X^-$ is an anion, e.g., halide, methylsulfate, and the like, methylsulfate being preferred. Longer alkyl chain sulfate radicals may also be used as the anion to make an effective quaternary compound for use herein. Especially preferred softeners herein are those wherein $R^1$ and $R^2$ are each $C_{12}$–$C_{20}$ fatty alkyl and $R_3$ and $R^4$ are each $C_1$–$C_4$ alkyl. The fatty alkyl groups can be mixed, i.e., the mixed $C_{10}$–$C_{18}$ coconutalkyl and mixed $C_{16}$–$C_{18}$ tallowalkyl quaternary compounds. Alkyl groups $R^3$ and $R^4$ are preferably methyl.

Exemplary quaternary ammonium conditioning agents herein include ditallowalkyldimethylammonium methylsulfate and dicoconutalkyldimethylammonium methylsulfate.

Another type of organic fabric conditioning agent optionally employed in the present articles and processes comprises the nonionic esterified cyclic dehydration products of sorbitol. Sorbitol, itself prepared by the catalytic hydrogenation of glucose, can be dehydrated in well-known fashion to form mixtures of cyclic 1,4- and 1,5-sorbitol anhydrides, i.e., "sorbitan." (See U.S. Pat. No. 2,322,821, Brown, PARTIAL ESTERS OF ETHERS OF POLYHYDROXYLIC COMPOUNDS, issued June 29, 1943.) The resulting complex mixtures of cyclic anhydrides of sorbitol are collectively referred to herein as "sorbitan."

The optional sorbitan-based conditioning agents are prepared by esterifying the "sorbitan" mixture with a fatty acyl group in standard fashion, e.g., by reaction with a fatty ($C_{10}$–$C_{24}$) acid halide. The esterification reaction can occur at any of the available hydroxyl groups, and various mono-, di-, etc., esters can be prepared. In fact, complex mixtures of mono-, di-, tri-, and tetra-esters almost always result from such reactions, and the stoichiometric ratios of the reactants can simply be adjusted to favor the desired reaction product. The sorbitan mono-esters and di-esters are preferred for use in the present invention, but all such esters are useful.

The foregoing complex mixtures of esterified cyclic dehydration products of sorbitol are collectively referred to herein as "sorbitan ester." Sorbitan mono- and di-esters of lauric, myristic, palmitic, stearic and behenic acids are particularly useful herein for imparting a soft, lubricious feel and anti-static benefit to fabrics. Mixed sorbitan esters, e.g., mixtures of the foregoing esters, and mixtures prepared by esterifying sorbitan with fatty acid mixtures such as the mixed tallow and hydrogenated palm oil fatty acids, are useful herein and are economically attractive. Unsaturated $C_{10}$–$C_{18}$ sorbitan esters, e.g., sorbitan mono-oleate, usually are present in such mixtures. It is to be recognized that all sorbitan esters, and mixtures thereof, which flow at dryer operating temperatures, i.e., above about 38°–40° C, and which have fatty hydrocarbyl "tails," are useful optional softeners in the context of the present invention.

The preferred alkyl sorbitan esters herein comprise sorbitan monolaurate, sorbitan monomyristate, sorbitan monopalmitate, sorbitan monostearate, sorbitan monobehenate, sorbitan dilaurate, sorbitan dimyristate, sorbitan dipalmitate, sorbitan distearate, sorbitan dibehenate, and mixtures thereof, the mixed coconutalkyl sorbitan mono- and di-esters and the mixed tallowalkyl sorbitan mono- and di-esters. The tri- and tetra- esters of sorbitan with lauric, myristic, palmitic, stearic and behenic acids, and mixtures thereof, are also useful herein.

It will be recognized that the sorbitan esters can be either ethoxylated or nonethoxylated. Although the nonethoxylated sorbitan ester materials are preferred, ethoxylates wherein one or more of the —OH groups contain 1 to about 6 oxyethylene moieties are very useful herein.

Other types of optional nonionic organic fabric conditioning agents which can be employed herein comprise fatty alcohols, fatty acids, glycerides, polyglycerol esters, and the like. When employed in an automatic clothes dryer, such materials impart the tactile impression of softness/lubricity to the finally dried fabrics.

The preferred conditioning agents of the above type encompass the substantially water-insoluble compounds selected from the group consisting of alcohols, carboxylic acids, carboxylic acid salts, and mixtures of these compounds. By "substantially water-insoluble" herein is meant a water solubility of 1% by weight, or less, at 20° C. The alcohols are preferred for use herein by virtue of their excellent fabric softening properties. Moreover, alcohol, especially cetyl alcohol, from the treated fabrics can be slowly transferred to skin on contact with the fabric to provide prolonged emolliency benefits. Mono-ols, di-ols and poly-ols having the requisite melting points and water-insolubility properties set forth above are useful herein. Such alcohol-type materials include the mono- and di-fatty glycerides which contain at least one "free" OH group.

All manner of water-insoluble, high melting alcohols (including mono- and di-glycerides), carboxylic acids and carboxylate salts are useful herein, inasmuch as all such materials coat fibers and dry to a non-tacky fabric finish. Of course, it is desirable to use those materials which are colorless, so as not to alter the color of the fabrics being treated. Toxicologically acceptable materials which are safe for use in contact with skin should be chosen.

Alcohols and mixtures thereof with melting points below about 38° C are not preferred for use herein. Only those alcohols which are solid or substantially solid at climatic temperatures commonly encountered are preferably employed in the present compositions. Liquid (low melting) alcohols can be applied to fabrics to increase lubricity, but the solid (high melting) alcohols provide the desired benefits without tackiness.

A preferred type of alcohol useful herein includes the higher melting members of the so-called fatty alcohol class. Although once limited to alcohols obtained from natural fats and oils, the term "fatty alcohols" has come to mean those alcohols which correspond to the alcohols obtainable from fats and oils, and all such alcohols can be made by synthetic processes. Fatty alcohols prepared by the mild oxidation of petroleum products are useful herein.

Another type of material which can be classified as an alcohol and which can be employed in the instant articles encompasses various esters of polyhydric alcohols. Such "ester-alcohol" materials which have a melting point within the range recited herein and which are substantially water-insoluble can be employed herein when they contain at least one free hydroxyl group, i.e., when they can be classified chemically as alcohols.

The alcoholic di-esters of glycerol useful herein include both the 1,3-di-glycerides and the 1,2-di-glycerides. The glycerides can be mixed with waxes, triglycerides, and the like, to provide a spectrum of tactile stimuli on the fabrics. In particular, di-glycerides containing two $C_8$–$C_{20}$, preferably $C_{10}$–$C_{18}$, alkyl groups in the molecule provide a soft handle to fabrics which is reminiscent of the effect achieved with the di-long chain alkylammonium fabric softeners in common use.

Mono- and di-ether alcohols, especially the $C_{10}$–$C_{18}$ di-ether alcohols having at least one free —OH group, also fall within the definition of alcohols optionally used herein. The ether-alcohols can be prepared by the classic Williamson ether synthesis. As with the ester-alcohols, the reaction conditions are chosen such that at least one free, unetherified —OH group remains in the molecule.

Non-limiting examples of ester-alcohols useful herein include: glycerol-1,2-dilaurate, glycerol-1,3-dilaurate, glycerol-1,2-dimyristate, glycerol-1,3-dimyristate, glycerol-1,2-dipalmitate, glycerol-1,3-dipalmitate, glycerol-1,2-distearate and glycerol-1,3-distearate. Mixed glycerides available from mixed tallowalkyl fatty acids, i.e., 1,2-ditallowalkyl glycerol and 1,3-ditallowalkyl glycerol, are economically attractive for use herein. The foregoing ester-alcohols are preferred for use herein due to their ready availability from natural fats and oils.

Ether-alcohols useful herein include glycerol-1,2-dilauryl ether, glycerol-1,3-distearyl ether, and butane tetra-ol-1,2,3-trioctanyl ether.

The substantially water-insoluble $C_{10}$–$C_{20}$ carboxylic acids and the substantially water-insoluble salts thereof, especially the magnesium and calcium salts, having melting points as set forth above are also useful conditioning agents in the articles and processes of this invention.

OPTIONAL INGREDIENTS

Various other optional additives can also be used in the processes and articles herein. Although not essential to the invention, certain fabric treating additives are particularly desirable and useful, e.g., brightening agents, shrinkage controllers, spotting agents, and the like.

Perfume additives are additional optional additives often employed with fabric conditioning compositions. However, due to a variety of reasons including both the lack of fabric substantivety and the high volatility of many desirable perfumes, treated fabrics often do not retain optimum levels of perfume, especially after a relatively short period of time.

The particulate clay of the invention herein can effectively carry and deposit perfumes onto treated fabrics. Further, these clays provide controlled release of perfumes from treated fabrics over appreciable periods of time. Moreover, these clays can be used for retarding perfume loss during processing and storage of fabric conditioning compositions and articles.

The perfumes employed herein will most often be liquid at ambient temperatures, but also can be solids such as the various camphoraceous perfumes known in the art. A wide variety of chemicals are known for perfumery uses, including materials such as aldehydes, ketones, esters and the like. More commonly, naturally-occurring plant and animal oils and exudates comprising complex mixtures of various chemical components are known for use as perfumes, and such materials are useful herein. The perfumes herein can be relatively simple in their composition, or can comprise highly sophisticated, complex mixtures of natural and synthetic chemical components, all chosen to provide any desired odor.

Typical perfumes herein can comprise, for example, woody/earthy bases containing exotic materials such as sandalwood oil, civet, patchouli oil, and the like. The perfumes herein can be of a light, floral fragrance, e.g., rose extract, violet extract and the like. The perfumes herein can be formulated to provide desirable fruity odors, e.g., lime, lemon, oranage, and the like. In short, any material which exudes a pleasant or otherwide desirable odor can be used in combination with particulate clay herein to provide a substantive, controlled release of the odor when applied to fabrics.

While not essential, liquids which serve as a diluent for the perfumes and organic conditioning agents can be employed. Such liquids can be used to more evenly impregnate absorbent carrier substrates with these agents. When a liquid diluent is so used, it should preferably be inert or stable with the agents and with the clay used herein. Isopropyl alcohol or isopropyl alcohol/-water mixtures are the preferred liquid carriers for these purposes; methanol, ethanol, acetone, ethylene glycol or propylene glycol can also be used.

Other additives can include various finishing aids, fumigants, lubricants, fungicides, and sizing agents. Specific examples of useful additives can be found in any current Year Book of the American Association of Textile Chemists and Colorists. When the compositions of the invention are dispensed from a spray device (e.g., aerosol can, mechanical pump spray, etc.) the composition will generally be present with a relatively high level of a carrier in said devices, the carriers being such materials as solvents and/or propellants. In such devices, the compositions of the present invention are used at levels of about 5% to 30% composition and 95% to 70% carrier. Examples of solvent carriers are ethanol and isopropanol and mixtures of these solvents with water. Examples of propellants are the Freons (e.g., Freon 12 and Freon 114). For purposes of describing the invention herein, the carrier materials will be considered part of the dispensing device.

The low-melting and water-soluble "distributing agents" designed to help evenly deposit materials on fabric surfaces can optionally be employed herein. Such materials include urea, lower carboxylic acids, and the like, all as set forth in British patent specification No. 1,313,697, Rapisarda and Rudy, entitled ADDITIVES FOR CLOTHES DRIERS, Apr. 18, 1973, incorporated herein by reference.

The amounts of such additives (e.g., fumigants, perfumes and brighteners) used herein are generally small, being in the range of from 0.001% to about 10% by weight of the total softening composition.

In preparing the flexible substrate articles herein containing both the clay particles and the organic softener and/or anti-stat, it is often advantageous, but not necessary, to include a surfactant to help provide easy, yet controlled and uniform release of the organic agents from the carrier. Uniform release helps prevent staining of synthetic fabrics.

Various surfactants are useful herein. For example, the nonionics, especially the well-known ethoxylated fatty alcohols having a hydrophilic-lipophilic balance of from about 2 to about 15, are useful herein. Anionic surfactants, especially tallow alkyl sulfate, can also be employed.

It is to be understood that while the selection of surfactants is not critical to the operation of the articles herein, surfactant-conditioning agent mixtures can be employed to modify performance properties according to the desires of the formulator. The articles herein can contain from about 0% to about 40% by weight of article of a surfactant.

DISPENSING MEANS

The clay, organic fabric conditioning agent and adjunct materials of the foregoing type are employed as an article of manufacture in combination with a dispensing means which effectively releases a pre-selected amount in an automatic clothes dryer. Such dispensing means can be designed for single usage or for multiple uses.

One such article comprises a pouch releasably enclosing enough of the clay and organic softener to condition fabrics during several cycles of clothes. This multi-use article can be made by filling a hollow, open pore polyurethane sponge pouch with about 10 grams of the dry clay/organic fabric conditioning mixture. In use, the tumbling action of the dryer causes the particles to pass through the pores of the sponge and onto the fabrics. Such a filled sponge can be used to treat several loads of fabrics in conventional dryers, and has the advantage that it can remain in the dryer after use and is not likely to be misplaced or lost.

Still another article comprises an aerosol cannister containing the above-described softening compositions under pressure. The composition can be dispensed from this aerosol article onto the dryer drum in the manner more fully described in Rudy et al., U.S. Pat. No. 3,650,816, issued Mar. 21, 1972, incorporated herein by reference.

Other devices and articles suitable for dispensing the cationic/fatty polyol ester softening compositions is automatic dryers include those described in Dillarstone, U.S. Pat. Nos. 3,736,668, issued June 5, 1973; Compa et al., 3,701,202, issued Oct. 31, 1972; Furgal, 3,634,947, issued Jan. 18, 1972; Hoeflin, 3,633,538, issued Jan. 11, 1972 and Rumsey, 3,435,537, issued Apr. 1, 1969. All of these patents are incorporated herein by reference.

A highly preferred article herein comprises the clay/conditioning agent particles releasably affixed to a sheet of paper, woven or non-woven cloth substrate or other suitable absorbent substrate such that the action of the automatic dryer removes the particles and deposits them on the fabrics. As more fully described hereinafter, the particles can be releasably affixed to the sheet substrates in various ways, including by means of a melt of any of the above-disclosed organic fabric conditioning agents.

The use of particulate clay/conditioning agent mixtures with the sheet form has several advantages. For example, effective amounts of particles for use in conventional dryers can be easily sorbed onto and into the sheet substrate by simple dipping or padding processes. Thus, the user need not measure the amount of material necessary to condition fabrics. Additionally, the flat configuration of the sheet provides a large surface area which results in efficient release of the particles onto fabrics by the tumbling action of the dryer. Moreover, use of substantially uniform mixtures of organic fabric conditioning agents and particulate clay (even at relatively low levels of clay, e.g., 2 to 30% of the mixture) with flexible substrates reduces fabric staining by the promotion of even distribution of the organic fabric softener. Thus the level of organic fabric conditioning agents can be increased on the substrate without the normally attendant increase in fabric staining.

The water-insoluble paper, or woven or non-woven substrates used in the sheet articles herein can have a dense, or more preferably, open or porous structure. Examples of suitable materials which can be used as substrates herein include paper, woven cloth, and non-woven cloth. Another desirable substrate is one of foam-type characteristics such as polyurethane. The term "cloth" herein means a woven or non-woven substrate for the articles of manufacture, as distinguished from the term "fabric" which encompasses the clothing fabrics being treated.

Highly preferred paper, woven or non-woven "absorbent" substrates useful herein are fully disclosed in U.S. Pat. No. 3,686,025, Morton, TEXTILE SOFTENING AGENTS IMPREGNATED INTO ABSORBENT MATERIALS, issued Aug. 22, 1972, incorporated herein by reference. These substrates are particularly useful with articles comprising the clay particles and organic fabric conditioning agent. It is known that most substances are able to absorb a liquid substance to some degree; however, the term "absorbent," as used herein, is intended to mean a substance with an absorbent capacity (i.e., a parameter representing a substrate's ability to take up and retain a liquid) from 2 to 25 times its weight of water.

Dense, one-ply or ordinary kraft or bond paper in articles containing the clay/conditioning agent mixture can also be used herein as a dispensing means.

Determination of absorbent capacity values is made by using the capacity testing procedures described in U.S. Federal Specifications UU-T-595b, modified as follows:

(1) tap water is used instead of distilled water;
(2) the specimen is immersed for 30 seconds instead of 3 minutes;
(3) draining time is 15 seconds instead of 1 minute; and
(4) the specimen is immediately weighed on a torsion balance having a pan with turned-up edges.

Absorbent capacity values are then calculated in accordance with the formula given in said specification. Based on this test, one-ply, dense bleached paper (e.g., kraft or bond having a basis weight of about 32 pounds per 3,000 square feet) has an absorbent capacity of 3.5 to 4.

As noted above, suitable material which can be used as a substrate in the invention herein include, among others, sponges, paper, and woven and non-woven cloth. The preferred substrates of the compositions herein are cellulosic, particularly multi-ply paper and non-woven cloth; see U.S. Pat. No. 3,414,459, Wells, COMPRESSIBLE LAMINATED PAPER STRUCTURE, issued Dec. 3, 1968, the disclosures of which are incorporated herein by reference, for a preferred paper substrate for use herein.

Preferred non-woven cloth substrates herein are water-laid or air-laid and are made from cellulosic fibers, particularly from regenerated cellulose or rayon, which are lubricated with any standard textile lubricant. Preferably, the fibers are from 3/16 to 2 inches in length and are from 1.0 to 8 denier. Preferably, the fibers are at least partially oriented haphazardly, particularly substantially haphazardly, and are adhesively bonded together with a hydrophobic or substantially hydrophobic binder-resin, particularly with a nonionic self-cross-linking acrylic polymer or polymers. Preferably, the cloth comprises about 70% fiber and 30% binder-resin polymer by weight and has a basis weight of from about 5 to 40 grams per square yard.

The fabric conditioning articles of the present invention are structured to be compatible with conventional laundry dryer designs. While it is preferred to employ the articles of the present invention in an automatic laundry dryer, other equivalent machines can be employed, and in some instances, heat and drying air may be omitted for part or all of the cycle. Generally, however, heated air will be employed and such air will be circulated frequently in the dryer. Normally, there are from about 10 to 40 volume changes of drying air in the dryer drum per minute and the air moves at about 50 to 200 cubic feet per minute. These changing volumes of air create a drawing or suction effect which can, especially with small fabric loads, cause an item such as a sock, handkerchief or the like, or a fabric conditioning article, to be disposed on the surface of the air outlet of the dryer. A usual load of fabrics of from about 4 to 12 pounds dry weight will fill from about 10 to 70% of the volume of most dryers and will normally pose little difficulty. A sufficient number of tumbling items will normally be present to prevent any item from being drawn to the exhaust outlet or to cause it to be removed from the outlet. In the event, however, a fabric conditioning article is caused to be disposed in relation to the air exhaust outlet in such a manner as to cause blockage of passing air, undesirable temperature increases can result. In the case of fabric conditioning articles employing the normally solid or waxy organic fabric conditioning agents (e.g., sorbitan esters) which soften or melt under conditions of heat, the article may tend to adhere to an exhaust outlet.

The problem of blockage can be solved by providing openings in the article in the manner described in the U.S. patent applications of A. R. McQueary, Ser. No. 347,605, filed Apr. 3, 1973, and Ser. No. 347,606, filed Apr. 3, 1973, both incorporated herein by reference. More specifically, slits or holes are cut through the substrate to allow free passage of air. Of course if the conditioning article is not of sufficient size to block the vent no problem occurs.

The type and number of slit openings can vary considerably and will depend on the nature of the substrate material, its inherent flexibility or rigidity, the nature of the conditioning agent carried therein or thereon, and the extent to which increased passage of air therethrough is desired. The articles of this invention can comprise a large number of small slits of various types or configurations, or fewer larger slits. For example, a single rectilinear or wavy slit, or a plurality thereof, confined to within the area of a sheet and extending close to opposite edges of the article, can be employed. By maintaining a border around all edges of the conditioning article, a desired degree of flexibility and surface area availability to tumbling fabrics can be maintained. While, for example, rectilinear slits can be cut into a conditioning article completely to the edges of the article, confinement of the slits to within the area of the article will be preferred where the convenience of packaging the conditioning article in roll form is desired.

According to one preferred embodiment of the invention, a sheet of fabric-conditioning article is provided with a plurality of rectilinear slits extending in one direction, e.g., the machine direction of the web substrate, and in a substantially parallel relationship. The slits can be aligned or in a staggered relationship. A preferred embodiment will contain from 5 to 9 of such slits which will extend to within about 2 inches and preferably 1 inch from the edge of the web material which is, for example, a 9 × 11 inch sheet.

The slit openings in the conditioning articles of the invention can be in a variety of configurations and sizes, as can be readily appreciated. In some instances, it may be desirable to provide slit openings as C-, U-, or V-shaped slits. Such slits arranged in a continuous or regular or irregular pattern are desirable from the standpoint of permitting gate-like or flap structures which permit the passage of air therethrough.

In accordance with a preferred embodiment of the invention, a plurality of curvilinear slit openings, such as U-shaped, or C-shaped slits, are provided in a continuously patterned arrangement. These slit arrangements provide flap-like or gate-like structures which should approximate the size of the perforations normally employed in laundry dryer exhaust outlets. A width dimension of from about 0.02 to about 0.40 inch is preferred. U- or C-shaped slits, e.g., about 150 inch in diameter, are desirably provided in close proximity to each other, e.g., about 150 inch apart, as to simulate, for example, a fish-scale pattern. Such design, in addition to permitting passage of air, provides a degree of flexibility to the substrate and allows flexing or puckering of the article in use. Similarly, the slit openings can be arranged as spaced rows of slits or as a plurality of geometrical patterns. For example, a sheeted article of this invention can comprise a plurality of squares, circles, triangles or the like, each of which is comprised of a plurality of individual slits. Other embodiments including small or large S-shaped slits, X-slits or crosses, slits conforming to alphabetical or numerical patterns, logograms, marks, floral and other designs can also be employed.

As an alternative to slits, the article can be provided with one or more circular holes having a diameter of from about 0.02 inches to about 4 inches, from about 5 to about 40% of the surface area of the article comprising said holes. The holes can be disposed in any convenient relationship to one another but it is simplest, from a manufacturing standpoint, to punch the holes through the substrate in evenly spaced rows.

As was indicated above, a substrate which is porous and suitable for use in the articles of this invention is polyurethane foam. A foam of this type can be prepared by a variety of methods which are well known in the art. The processes generally involve the condensation of organic isocyanates, such as tolylenediisocyanate, with polyols such as polyethylene ether glycol, in the presence of a catalyst and blowing agent. Basic processes and apparatus for preparing such foams are disclosed, for example, in U.S. Pat. No. 2,764,565, Sept. 25, 1956, incorporated herein by reference. The polyurethane foam sheets used in the present invention can be of various sizes but are preferably from about 0.5 mm. to about 6 mm. thick. The density of the sheets is preferably from about 0.02 grams/cm$^3$ to about 0.045 grams/cm$^3$.

ARTICLE MANUFACTURE

The articles herein comprise the clays in combination with an organic softener and a dispensing means. When the dispensing means is to be a porous pouch, the clay/-conditioning agent mixture, either as solid particles or as gels, and optional ingredients, are simply admixed thoroughly and placed in the pouch, which is then sewn, or otherwise permanently sealed. The pouch is fashioned from a material whose average pore diameter is 10 to 15% larger than any solids contained therein. The tumbling action of the dryer causes the material to pass through the pores evenly onto all fabric surfaces.

Preferred articles herein are provided in sheet form, for the reasons disclosed above. A dispensing means comprising a carrier sheet is releasably coated with sufficient clay and organic conditioning agent to treat one average load (6–8 lbs) of fabrics. The coating process may involve, for example, coating the sheet with an inert, unobjectionable, somewhat tacky material such as any of the marine agars or glycols, and thereafter impressing the desired amount of clay/conditioning agent mixture into the coating. Heat and the tumbling action of the dryer releases the clay and conditioning agent onto fabric surfaces. The fabric conditioning agent, particularly wherein it is impregnated into the absorbent sheet substrate, provides both a fabric conditioning action and a means whereby the clay can be releasably affixed to the sheet.

Generally, in the case of absorbent sheet substrates, the clay can be releasably affixed with the organic conditioning agent to the substrate in two ways. For instance, the clay can be applied as part of an organic conditioning agent liquid melt which is sprayed or padded onto the substrate sheet. Alternatively, the suspensions of clay can be applied to the substrate which has already been impregnated with the organic conditioning agent. The former method is particularly suited to reduce fabric staining by promoting even release and distribution of the organic softener on treated fabrics. The latter method is particularly suited to reduce perfume loss during processing inasmuch as the perfume can be added with the clay at lower temperatures. Of course, combinations of these methods can also be employed.

Impregnation with the organic conditioning agent or other affixing agent for the clay can be done in any convenient manner, and many methods are known in the art. For example, the agent, in liquid form, can be sprayed onto a substrate or can be added to a woodpulp slurry from which the substrate is manufactured. Sufficient agent remains on the surface to conveniently affix the particles to the substrate.

In a preferred method of making the sheeted articles herein, the conditioning agent (along or with the optional additives) is applied to absorbent paper or nonwoven cloth by a method generally known as padding. The agent is preferably applied in liquid (melted) form to the substrate. The clay particles can thereafter be applied to the treated substrate in various ways.

In one preferred method, the conditioning agent is placed in a pan or trough which can be heated to maintain the agent in liquid form. To the liquid agent are then added any desired additives. A roll of absorbent paper (or cloth) is then set up on an apparatus so that it can unroll freely. As the paper unrolls, it travels downwardly and, submersed, passes through the pan or trough containing the liquified agent at a slow enough speed to allow sufficient impregnation. The absorbent paper then travels upwardly and through a pair of rollers which remove excess bath liquid and provide the paper with about 0.5 to about 12 grams of the agent per 100 in.$^2$ to 150 in.$^2$ of substrate sheet. The impregnated paper is then uniformly coated with the clay particles (generally 0.1 g. to 15 g. per 100 in.$^2$ to 150 in.$^2$) and cooled to room temperature, after which it can be folded, cut or perforated at uniform lengths, and subsequently packaged and/or used.

In another method, the conditioning agent, in liquid form, is sprayed onto absorbent paper as it unrolls and the excess agent is then squeezed off by the use of squeeze rollers or by a doctor-knife. Other variations include the use of metal "nip" rollers on the leading or entering surfaces of the sheets onto which the agent is sprayed; this variation allows the absorbent paper to be treated, usually on one side only, just prior to passing between the rollers whereby excess agent is squeezed off. This variation can optionally involve the use of metal rollers which can be heated to maintain the agent in the liquid phase. Optionally, the clay can be impressed onto the sheet by means of such rollers.

A particularly useful method of making the articles herein includes mixing from about 75 parts to about 95 parts of an organic conditioning agent (e.g., said agent comprising from about 5 to about 100% of a quaternary ammonium salt and from about 0 to about 95% of sorbitan ester) and from about 25 parts to about 5 parts by weight of a particulate clay (e.g., Gelwhite GP). Optional ingredients such as perfumes can be added to the mixture. Such a mixture flows well at elevated temperatures (e.g., 65° C) and can be padded or sprayed onto a moving paper or nonwoven substrate according to methods disclosed above. Alternatively, of course, clay and perfume can be sprayed onto the substrate after application of the organic conditioner base.

Generally in applying the fabric treatment mixture to the absorbent substrate, the amount of mixture impregnated into or coated onto the absorbent substrate is commonly in the weight ratio range of from about 10:1 to 0.5:1 based on the ratio of total fabric treatment mixture to dry, untreated substrate (fiber plus binder). Preferably the weight ratio of fabric treatment mixture to substrate ranges from about 5:1 to about 1:1, more preferably from about 3:1 to :1.

Following application of the liquified conditioning agent and the clay, the articles are held at room temperature until the agent solidifies. The resulting dry articles remain flexible; the sheet articles are suitable for packaging in rolls. The sheet articles can optionally be slitted or punched to provide a non-blocking aspect at any convenient time during the manufacturing process.

USAGE

The mixture of clay and organic conditioner is desirably employed at a weight ratio of organic:clay of from about 200:1 to 1:1, more preferably 60:1 to 2:1. It is to be understood that the amount of the conditioner mixture employed herein can vary according to the desires of the user, the type of fabric being treated, the relative humidity of the surrounding atmosphere and like factors. For most purposes the compositions herein are applied to fabrics at a rate of about 0.01 gram to about 12.0 grams, preferably 0.2 gram to about 5 grams per, 5 lbs. of fabrics on a dry weight basis. The above-disclosed ratios and usage levels give good results over a wide variety of conditions, but are in no way intended to be limiting of the scope of the invention.

The process herein is carried out in the following manner. Damp fabrics, usually containing from about 0.2 to about 1.5 times their weight of water, are placed in the drum of an automatic clothes dryer. In practice, such damp fabrics are commonly obtained by laundering, rinsing and spin-drying the fabrics in a standard washing machine. An article prepared in the manner of this invention releasably containing an effective amount of a clay/organic conditioning agent mixture is simply added thereto. Alternatively, the compositions can be sprayed (e.g., from a pump spray or propellant charged aerosol container) or otherwise coated on the dryer drum itself. The dryer is then operated in standard fashion to dry the fabrics, usually at a temperature from about 50° to about 80° C for a period from about 10 minutes to about 60 minutes, depending on the fabric load and type. The tumbling action of the revolving dryer drum evenly distributes the active ingredients from the article over all fabric surfaces, and the heat dries the fabrics. On removal from the dryer, the dried fabrics are desirably conditioned.

The following examples illustrate the practice of this invention. It is to be recognized that the mixtures disclosed above desirably impart both an antistatic and softening benefit to fabrics treated therewith. The clay-/organic conditioning agent combination provides not only combined softening and antistatic benefits but, furthermore, reduces fabric staining and dryer corrosion, and effectively carries perfume to treated fabrics. Thus flexible sheet substrates containing a blended mixture at a weight ratio of organic:clay as given hereinabove can reduce fabric staining caused by uneven distribution of the organic fabric conditioner. Moreover, flexible substrates having clay materials padded or sprayed onto a layer of organic fabric conditioner can very effectively carry and deposit perfume onto treated fabrics. Such spraying or padding of a clay/perfume mixture onto a sheet having a previously applied layer of organic fabric conditioner base carries and deposits higher levels of perfume than if the perfume/clay mixture is merely mixed with the organic conditioner base.

All percentages used herein are by weight unless otherwise specified.

EXAMPLE I

Five different types of fabric conditioning articles in sheet configuration were prepared by impregnating a flexible non-woven substrate with a liquified organic fabric conditioning agent mixture comprising ditallowalkyldimethylammonium methylsulfate and sorbitan ester, and then treating the impregnated substrate with varying amounts of particulate clay (Gelwhite GP).

Individual impregnated articles are 9 × 11 inches in size and comprise the following components set out below and described hereinafter.

The flexible substrate utilized was non-woven and made of rayon fiber (~70%) and polyvinyl acetate binder (~30%). The fiber utilized was approximately 1 9/16 inches in length and had a denier of 3. The substrate had an absorbent capacity of about 6.5 and was provided in a roll containing detachable sheets which are 9 by 11 inches in size.

The ditallowalkyldimethylammonium methylsulfate in the softener and antistat mixture was obtained as a commercial product from the Ashland Chemical Company. The sorbitan ester comprises the $C_{16}$ and $C_{18}$ alkyl mono, di, tri and tetra esters of sorbitan, isosorbide and small amounts of sorbitol (collectively "sorbitan esters") and was obtained as a commercial product from Glycomul Corporation as Glycomul S. This sorbitan ester mixture contains from about 52 to 59% by weight of $C_{16}$ material and from about 41 to 49% $C_{18}$ material. The sorbitan ester mixture further comprises from about 29 to 33% by weight of the monoester component, from about 28 to 38% by weight of the diester component and from about 23 to 32% by weight of the tri and tetra ester component with the remainder being unreacted material. The weight ratio of ditallowalkyldimethylammonium methylsulfate to sorbitan ester was about 7 to 3.

The particulate clay (Gelwhite GP marketed by Georgia Kaolin Co.) was a smectite clay and was in the form of an impalpable powder having a particle size of from about 0.05 to about 25 microns.

Perfume was added to the liquified mixture at about 1.6% by weight. The perfume is a highly volatile, complex mixture of natural and synthetic odors obtained from International Flavors and Fragrances, Inc.

The liquefied softener and antistatic mixture as described above was prepared by simply admixing the individual components at 70° C. The flexible substrate was impregnated by coating one side of a continuous flexible substrate of the above described properties. The coated side of the substrate was contacted with a rotating cylindrical member which served to press the liquified mixture into the interstices of the substrate. The substrate was passed over several chilled tensioning rolls which helped solidify the softener and antistatic mixture. The substrate sheet was 9 inches wide and was perforated in lines at 11 inch intervals to provide detachable sheets. Each sheet was cut with a set of knives to provide six parallel slits in the sheet 1-3/16 inches apart. Such slits averaged in length from 5 to 7 inches Such fabric conditioning articles can be utilized in the laundry dryer to provide fabric softening and static control. Further, such articles transfer a desirable degree of perfume to treated fabrics.

Performance evaluation of the articles set out in Table I is made according to the following three tests.

FABRIC STAINING TESTS

Two fabric staining tests are employed to evaluate the degree of staining provided by fabric conditioning articles as prepared in Example I. These tests are described below.

(A) "Sandwich" Test

In this test simulated dryer conditions are employed to evaluate the degree of staining provided by various conditioning articles. The test involves building a "sandwich" with the conditioning article as the center and heating this sandwich to dryer temperatures.

The sandwich essentially consists of outmost layers of vinyl asbestos floor tiles (5 × 5 inches) wrapped in aluminum foil. The next outermost layers are tightly woven 65/35% polyester/cotton fabric (5 × 5 inches). Finally, the center consists of the flexible substrate sheet conditioning article (5 × 5 inches).

This "sandwich" is held together with rubber fasteners and is placed in a constant temperature oven at 180° F for 30 minutes. The "sandwich" is removed and cooled. The polyester/cotton fabrics are then graded for staining on the basis of 0–10 scale. A score of 10 indicates no staining while a scale of 0 indicates heavy staining.

The results of such a test with varying amounts of clay affixed to the flexible sheet are set out in Table II.

(B) Dryer Fabric Staining Test

In this test a 5¼ lb. load of fabrics is washed with nine colored swatches covering a range of color, fiber types and weaves and varying in size from about 20 to 22 inches in length and from about 12.5 to about 19 inches in width. The freshly washed fabrics and swatches are then placed in a conventional dryer with a 9 × 11 inches conditioning article.

The fabrics are dried, removed and graded on a basis of the percent of swatches that have serious staining and the percent of swatches that have any staining. The results of the test using articles with varying levels of clay fabric conditioners appear in Table II.

FABRIC ODOR TEST

This test is employed for determining the amount of perfume transferred to fabrics during conditioning of the fabrics in an automatic dryer.

In this test, 3½ lbs. of freshly washed fabrics (terry wash cloths obtained from Test Fabrics, Inc., of New York) are dried for 45 minutes in a conventional dryer. At the start of the drying cycle, a 9 × 11 inches fabric conditioning article prepared as in Example I is placed on top of the fabrics in the dryer.

At the end of the drying cycle, the fabrics are removed, folded in quarters and wrapped in aluminum foil. Paired grading of odor is made by comparing five treated fabrics (control) with five test treated fabrics.

Results of the test are shown in Table II. A score of 0 represents no perfume odor. A score of 10 represents a very high impact, easily recognizable perfume odor. Intermediate grades represent intermediate degrees of perfume odor impact.

Grading is carried out at three different periods. First, within about two hours after removal from the dryer; second, after 1 day; third, after 5 days. The samples, which are graded (by a grading expert), are kept in the aluminum foil until each grading session.

RESULTS

Results in each of the above-described tests appear below in Table II. Articles A through E represent articles which have from 0.05 to about 0.4 grams of clay affixed to the substrate as described in Example I. Article F contains no clay.

TABLE I

| SHEET | FABRIC CONDITIONING SHEETS A | B | C | D | E | F |
|---|---|---|---|---|---|---|
| COMPONENTS* | | | | | | |
| Clay | 0.05 | 0.10 | 0.20 | 0.30 | 0.40 | 0 |
| Quaternary | 1.84 | 1.84 | 1.84 | 1.84 | 1.84 | 1.84 |
| Sorbitan Ester | 0.80 | 0.80 | 0.80 | 0.80 | 0.80 | 0.80 |
| Perfume | 0.043 | 0.043 | 0.044 | 0.046 | — | 0.042 |
| Substrate | 1.53 | 1.53 | 1.53 | 1.53 | 1.53 | 1.53 |

*Composition is in grams per sheet.

TABLE II

| SHEET | TEST RESULTS A | B | C | D | E | F |
|---|---|---|---|---|---|---|
| TEST | | | | | | |
| FABRIC STAINING | | | | | | |
| Sandwich Test Grade | 3 | 6 | 7½ | 8 | 9 | 1 |
| Dryer Stain Grade | | | | | | |
| % Swatches having serious staining | — | 11 | 11 | — | 7 | 22 |
| % Swatches having any staining | — | 11 | 15 | — | 9 | 28 |
| FABRIC ODOR IMPACT GRADE | | | | | | |
| Initial | 6 | 5 | 6 | — | — | 6 |
| 1 day old | 6 | 6 | 6 | — | — | 3 |
| 5 days old | 3 | 4 | 5 | — | — | 2 |

EXAMPLE II

In this example, fabric conditioning articles in flexible substrate sheet form were prepared similarly to the articles of Example I with one exception. The order of clay addition was different.

In this example, the clay was mixed with water and perfume and sprayed onto the sheet, either completely covering the surface of the article or such that a narrow strip was formed, after the substrate had been impregnated with a mixture of ditallowalkyldimethylammonium methylsulfate and sorbitan ester. The substrate was dried after addition of the clay/perfume/water mix to drive off excess water.

The articles had the components by weight in grams per sheet as shown in Table III along with the results

TABLE III

| SHEET | FABRIC CONDITIONING SHEETS A | B | C | D | E | F | G | H |
|---|---|---|---|---|---|---|---|---|
| COMPONENTS* | | | | | | | | |
| Substrate | 1.53 | 1.53 | 1.53 | 1.53 | 1.53 | 1.53 | 1.53 | 1.53 |
| Initial Layer | | | | | | | | |
| Quaternary | 1.84 | 1.84 | 1.84 | 1.84 | 1.84 | 1.84 | 1.84 | 1.84 |
| Sorbitan Ester | .79 | .79 | .79 | .79 | .79 | .79 | .79 | .79 |
| Perfume | 0.042 | — | — | — | 0.084 | — | 0.173 | — |
| Top Layer | | | | ** | | | | |
| Clay | — | — | 0.015 | 0.026 | — | 0.015 | — | 0.015 |
| Perfume | — | 0.042 | 0.042 | 0.045 | — | 0.084 | — | 0.168 |
| Water | — | 0.258 | 0.243 | 0.230 | — | 0.201 | — | 0.117 |
| Fabric Odor Impact Grade, Initial | 3 | 2 | 5 | 6 | 4 | 7 | 7 | 10 |

*Composition is in grams per sheet.
**In run D, the top layer was applied in a 1-inch wide strip approximately 11 inches long.

It is seen from Table III that these articles are found to impart higher levels of perfume to treated fabrics as compared to a similarly prepared article having the clay admixed with the quaternary ammonium salt/sorbitan ester mixture before application to the substrate.

Thus a particularly desirable embodiment of the invention herein comprises a flexible substrate sheet having (1) a substrate with an organic fabric conditioner impregnated thereto, and (2) a thin layer of a particulate clay carrying perfume on one or both sides of the impregnated sheet.

Substantially similar fabric softening articles are also prepared with a slight variation in the softening and antistatic mixture. In these second sets of articles, the weight ratio of ditallowalkyldimethylammonium methylsulfate to sorbitan ester is about 9:1. Further, these second sets of articles contain sorbitan esters that are by weight about 59% $C_{16}$ material and about 41% $C_{18}$ material. The sorbitan ester further comprises by weight about 32% monoester, about 37% diester and about 23% tri- and tetraester components.

What is claimed is:

1. An article of manufacture especially adapted for conditioning fabrics in an automatic clothes dryer, comprising:

(a) an effective amount of a smectite clay/organic fabric conditioning agent mixture wherein the weight ratio of organic fabric conditioning agent to smectite clay is from about 200:1 to about 1:1 and wherein the organic fabric conditioning agent is cationic; and (b) a dispensing means which provides for release of said mixture within an automatic clothes dryer.

2. An article according to claim 1 wherein the organic fabric conditioning agent is a mixture of cationic and nonionic fabric conditioning agents, said mixture containing not less than 5% cationic fabric conditioning agent.

3. An article according to claim 2 wherein the weight ratio of organic fabric conditioning agent to smectite clay is from about 60:1 to about 2:1.

4. An article according to claim 3 wherein said mixture is in a substantially dry state and wherein the dispensing means is an absorbent substrate.

5. An article according to claim 4 wherein the absorbent substrate is a paper or woven or non-woven cloth sheet.

6. An article according to claim 5 wherein the cationic fabric conditioning agent is a quaternary ammonium compound and the nonionic fabric conditioning agent is a sorbitan ester.

7. An article according to claim 4 wherein the weight ratio of organic fabric conditioning agent plus smectite clay to absorbent substrate is from about 10:1 to 0.5:1.

8. An article according to clay 7 wherein the organic fabric conditioning agent and smectite clay have an effective amount of a perfume incorporated therewith.

9. An article according to claim 8 wherein the clay and perfume form a layer on the surface of the conditioning article.

10. An article according to claim 4 wherein the absorbent substrate is a polyurethane foam.

11. An article according to claim 10 wherein the cationic fabric conditioning agent is a quaternary ammonium compound and the nonionic fabric conditioning agent is a sorbitan ester.

12. An article according to claim 1 wherein the dispensing means is an aerosol device.

13. A process for conditioning fabrics comprising:

(a) applying to fabrics in an automatic clothes dryer an effective amount of a smectite clay/organic fabric conditioning agent mixture wherein the weight ratio of organic fabric conditioning agent to smectite clay is from about 200:1 to about 1:1 and wherein the organic fabric conditioning agent is cationic; and (b) manipulating said fabrics to disperse the smectite clay/organic conditioning agent mixture.

14. A process according to claim 13 wherein the organic fabric conditioning agent is a mixture of cationic and nonionic fabric conditioning agents, said mixture containing not less than 5% cationic fabric conditioning agent.

15. A process according to claim 14 wherein the weight ratio of organic fabric conditioning agent to smectite clay is from about 60:1 to about 2:1.

16. A process according to claim 15 wherein the mixture is in a substantially dry state and wherein said mixture is dispensed into the dryer from an absorbent substrate.

17. A process according to claim 16 wherein the cationic fabric conditioning agent is a quaternary ammonium compound and the nonionic fabric conditioning agent is a sorbitan ester.

18. A process according to claim 17 wherein the organic fabric conditioning agent and smectite clay have an effective amount of a perfume incorporated therewith.

19. A process according to claim 13 wherein the smectite clay/organic fabric conditioning agent mixture is dispensed into the dryer from an aerosol dispensing device in a manner so as to coat the dryer drum before tumbling the fabrics in the dryer.

* * * * *

UNITED STATES PATENT AND TRADEMARK OFFICE

CERTIFICATE OF CORRECTION

PATENT NO. : 4,073,996

DATED : February 14, 1978

INVENTOR(S) : William T. Bedenk & Paul J. Sagel

It is certified that error appears in the above-identified patent and that said Letters Patent are hereby corrected as shown below:

Col. 2, line 57, "described" should be -- describe --

Col. 5, line 20, "$R_3$" should be -- $R^3$ --.

Col. 12, line 29, "150" should be -- 1/8 --.

Col. 12, line 31, "150" should be -- 1/8 --.

Signed and Sealed this

*Twentieth* Day of *June 1978*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,073,996

DATED : March 14,1973

INVENTOR(S) : Richard COHEN-ALLORO et al

It is certified that error appears in the above-identified patent and that said Letters Patent are hereby corrected as shown below:

IN THE ABSTRACT:

Line 4 - After "table" delete ","

IN THE SPECIFICATION:

Column 1, line 5 - after "invention" delete ","

line 11 - delete "device" insert-- devices-- line 13 - after "tables" delete "known,"

Column 2, line 23 - after "invention" , delete "as" insert --is--

UNITED STATES PATENT AND TRADEMARK OFFICE

CERTIFICATE OF CORRECTION

PATENT NO. : 4,073,996

DATED : March 14, 1973

INVENTOR(S) : Richard COHEN-ALLORO et al

It is certified that error appears in the above-identified patent and that said Letters Patent are hereby corrected as shown below:

Column 3, line 9 - delete "top" insert -- tops -- line 29 - delete "serve" insert -- serves --

Column 4, line 10 - after "coupling" insert -- 34 -- line 43 - after "which" insert -- can be of --

Column 5, line 2 - delete "ofspongy" insert -- of spongy --

IN THE CLAIMS:

Column 5, line 27 - after "having" insert -- a --

Column 6, line 17 - after "arranged" delete "."

Signed and Sealed this

*Nineteenth* Day of *September 1978*

[SEAL]

*Attest:*

RUTH C. MASON
*Attesting Officer*

DONALD W. BANNER
*Commissioner of Patents and Trademarks*